US007478797B2

(12) United States Patent
Laws et al.

(10) Patent No.: US 7,478,797 B2
(45) Date of Patent: Jan. 20, 2009

(54) MOLDED DECORATIVE FENCE PANEL

(75) Inventors: David J. Laws, Provo, UT (US); R. Dru Laws, Pleasant Grove, UT (US); Gregory Wilson, Sandy, UT (US); Phillip Swindler, Provo, UT (US); Robert Magdars, Saratoga Springs, UT (US); John A. Johnson, Orem, UT (US)

(73) Assignee: MFS, LLC, Orem, UT (US)

( * ) Notice: Subject to any disclaimer, the term of this patent is extended or adjusted under 35 U.S.C. 154(b) by 334 days.

(21) Appl. No.: 11/256,216

(22) Filed: Oct. 21, 2005

(65) Prior Publication Data

US 2007/0090334 A1 Apr. 26, 2007

(51) Int. Cl.
*E04H 17/14* (2006.01)

(52) U.S. Cl. ..... 256/19; 256/24; 256/73; 52/316; 52/795.1

(58) Field of Classification Search ..... 256/19, 256/24, 66, 65.02, 65.11, 73; 52/316, 793.1, 52/795.1
See application file for complete search history.

(56) References Cited

U.S. PATENT DOCUMENTS

| | | | | | |
|---|---|---|---|---|---|
| 3,254,464 | A * | 6/1966 | Hoyt, Jr. | ..... | 256/19 |
| 5,078,367 | A * | 1/1992 | Simpson et al. | ..... | 256/24 |
| 5,245,733 | A | 9/1993 | Goria | | |
| 5,269,991 | A | 12/1993 | Gueret | | |
| 5,321,873 | A | 6/1994 | Goria | | |
| 5,702,090 | A * | 12/1997 | Edgman | ..... | 256/19 |
| 5,911,927 | A | 6/1999 | Roberts | | |
| 6,345,809 | B1 * | 2/2002 | Bebendorf | ..... | 256/24 |
| 6,637,728 | B2 * | 10/2003 | Pettit et al. | ..... | 256/19 |
| 6,719,277 | B2 * | 4/2004 | Ohanesian | ..... | 256/19 |
| 6,726,864 | B2 | 4/2004 | Nasr et al. | | |
| 6,944,998 | B1 | 9/2005 | King | | |
| 2002/0000545 | A1 * | 1/2002 | Pettit et al. | ..... | 256/19 |
| 2002/0145229 | A1 | 10/2002 | Kuriger et al. | | |
| 2005/0087908 | A1 | 4/2005 | Nasr et al. | | |

OTHER PUBLICATIONS

Product Specifications for GenStone, See Website—http://www.genstoneproducts.com/simulated-rock-stone-brick-specs.cfm, printed Feb. 17, 2006, pp. 1-3.

(Continued)

*Primary Examiner*—Michael P Ferguson
(74) *Attorney, Agent, or Firm*—Thorpe North & Western, LLP

(57) ABSTRACT

The opposite plastic walls 20*a* and 20*b* can be made from a polymeric resin material such as thermoplastic or thermoset resin, and/or can be made from olefins, styrenes, nylons, or mixtures of these polymeric families. In one aspect, the opposite plastic walls can be formed from an olefin, such as polyethylene or polypropylene, or the like. In another aspect, the opposite plastic walls can be formed from a styrene, such as acrylonitrile or butadiene styrene, or the like. In still another aspect, the opposite plastic walls can be formed from a mixture of olefins and styrenes. The polymeric resin material can also be made from recycled olefin, styrene, or nylon products. It will also be appreciated that the material of the walls can include additives, such as glass, fiber, talc, UV resistive or protective materials, etc. In one aspect, plastic granules of different colors can be combined to obtain a wall color that is a composite color to more readily simulate another material.

42 Claims, 14 Drawing Sheets

OTHER PUBLICATIONS

Application and Uses for GenStone, See Website—http://www.genstoneproducts.com/applications-uses.cfm, printed Feb. 17, 2006, pp. 1-2.

Cultured Stone Manufactured Stone Veneer, See Website—http://www.culturedstone.com/index.asp, printed Feb. 17, 2006, pp. 1-2.

Advanced Rock Technologies, See Website homepage—http://www.advancedrock.net, printed Feb. 17, 2006, pp. 1-2.

Advanced Rock Technologies, Rocky Mountain Cut Sandstone Panels, See Website—http://www.advancedrock.net/RockyStone.asp?, printed Feb. 17, 2006, pp. 1-3.

Advanced Rock Technologies, Old Schoolhouse Brick Panels, See Website—http://www.advancedrock.net/oldbrick.asp?, printed Feb. 17, 2006, pp. 1-3.

Hoover Fence Company, Decorative Vinyl rock Posts / Columns, See Website—http://www.hooverfence.com/vinyl/columns/columns.htm, printed Feb. 17, 2006, pp. 1-2.

"What is Rotational Molding?", Goria Corporation literature, See Website—http://www.goriacorp.com/plastic.htm, printed Mar. 13, 2006, pp. 1-2.

Literature from Advanced Rock Technologies, LLC of Golden, Colorado, "Rocky Mountain Cut Sandstone Panel," pp. 1-2.

Literature from Tuftek Composites, "Stonehenge," Privacy and Stone Walls, printed Feb. 1, 2004, pp. 1-21.

* cited by examiner

MOLDED DECORATIVE FENCE PANEL

BACKGROUND OF THE INVENTION

1. Field of the Invention

The present invention relates generally to fences, and more particularly to polymeric fencing material molded to simulate traditional fencing materials.

2. Related Art

Fences are commonly used to delineate borders between homes or lots. There are many types of fences and fencing materials that are used in residential fencing, such as chain link, wood, vinyl, rock, stone, brick, and concrete.

Chain link fences are considered by many to be aesthetically unattractive and easily damaged. Furthermore, damaged chain link is difficult to fix or replace since either the entire length of chain link fabric must be replaced, or the damaged area must be removed and a new section knitted into the existing undamaged fence. In either case, the repair is not easily accomplished and often results in a less attractive fence.

Many consider wood fences to be more attractive than chain link. However, wood can quickly deteriorate from exposure to the weather. Consequently, wood fences can be high maintenance and must be painted or oiled in order to retain aesthetically pleasing attributes.

Vinyl fences are preferred by some, and can require less maintenance than wood fences. However, vinyl fencing is relatively brittle and weak, and therefore can be easily damaged. Additionally, damaged vinyl fencing is not easily repaired or replaced, and often requires removal and replacement of fence posts to repair even a single slat.

Rock, stone and brick fences can be attractive, long lasting, low maintenance, and can have high strength. However, masonry products are expensive when compared to other fencing materials. Additionally, such fences are not easily repaired when damaged.

Some fences are made of concrete that has been molded and shaped to look like rock or stone fences. Concrete fences and walls are difficult and costly to install. Additionally, concrete fences can be expensive and difficult to repair or replace.

Molded fences have been made that simulate other fencing materials such as rock or stone. Such molded fencing, however, has problems with warping due to thermal differentials on opposite sides of the fence. In addition, such molded fencing often uses complicated molding processes to achieve sand and/or color on the surface of the fence, which can be easily marred, leaving an unattractive surface that is difficult to repair or replace.

SUMMARY OF THE INVENTION

It has been recognized that it would be advantageous to develop a molded polymeric resin fence panel that attractively simulates other fencing materials such as rock, wood, brick, stone and the like. Additionally, it has been recognized that it would be advantageous to develop a molded polymeric fence panel that resists warping due to differential thermal loads on opposite sides of the panel. It has also been recognized that it would be advantageous to develop a molded polymeric fence panel that can accommodate different decorative surfaces on opposite sides of the panel. It has also been recognized that it would be advantageous to develop a molded polymeric fence system that is easily installable, configurable, changeable, repairable and/or replaceable.

The invention provides a decorative fence panel including opposite plastic walls that have opposite facing exterior surfaces. Each wall has a grid of traversing elongated channels formed by inward deflections in the walls to define a decorative profile of a fence. A plurality of discrete physical connections is disposed across the decorative fence panel. The connections are formed between the opposite walls by select intersections of the grids of traversing channels of the opposite walls. The connections form a plurality of continuous material nodes of thermal and mechanical energy transfer paths between the opposite walls to transfer thermal and mechanical energy between the opposite walls. The continuous material nodes transfer heat from one wall to the other to resist differential thermal expansion between the opposite walls, and thus resist warping of the decorative fence panel.

In accordance with another more detailed aspect of the invention, opposite sides of the decorative fence panel can simulate a different fencing material.

In accordance with another aspect the present invention provides for a fence system including a plurality of decorative posts that are securable to a support surface. Each post has at least one longitudinal vertical groove formed in a side. A plurality of decorative fence panels is disposable between adjacent posts. Each decorative fence panel has a lateral peripheral edge at least partially disposable within the vertical grooves of the adjacent posts.

The invention also provides a method for installing a fence including securing a plurality of posts. Each post can have at least one vertical groove to a support surface. A decorative fence panel can be slid into the vertical grooves of adjacent posts. The decorative fence panel can be slid into the vertical grooves from openings near upper ends of the posts, such that elongated reinforcing inserts engage bottoms of the vertical grooves to secure the decorative panel between the adjacent posts. Elongated reinforcing members can be slid into a top and a bottom of the decorative fence panel.

The invention also provides a method of making a decorative fence panel including providing a mold having opposing mold surfaces with a grid of traversing protrusions formed on each mold surface and extending toward the opposing mold surface. The protrusions define an inverse decorative profile of a fence, and form a plurality of select gaps between the grids of transverse protrusions. A moldable plastic material can be introduced into the mold. The plastic material can be molded to form the decorative fence panel.

Additional features and advantages of the invention will be apparent from the detailed description which follows, taken in conjunction with the accompanying drawings, which together illustrate, by way of example, features of the invention.

DETAILED DESCRIPTION

Figure 1:
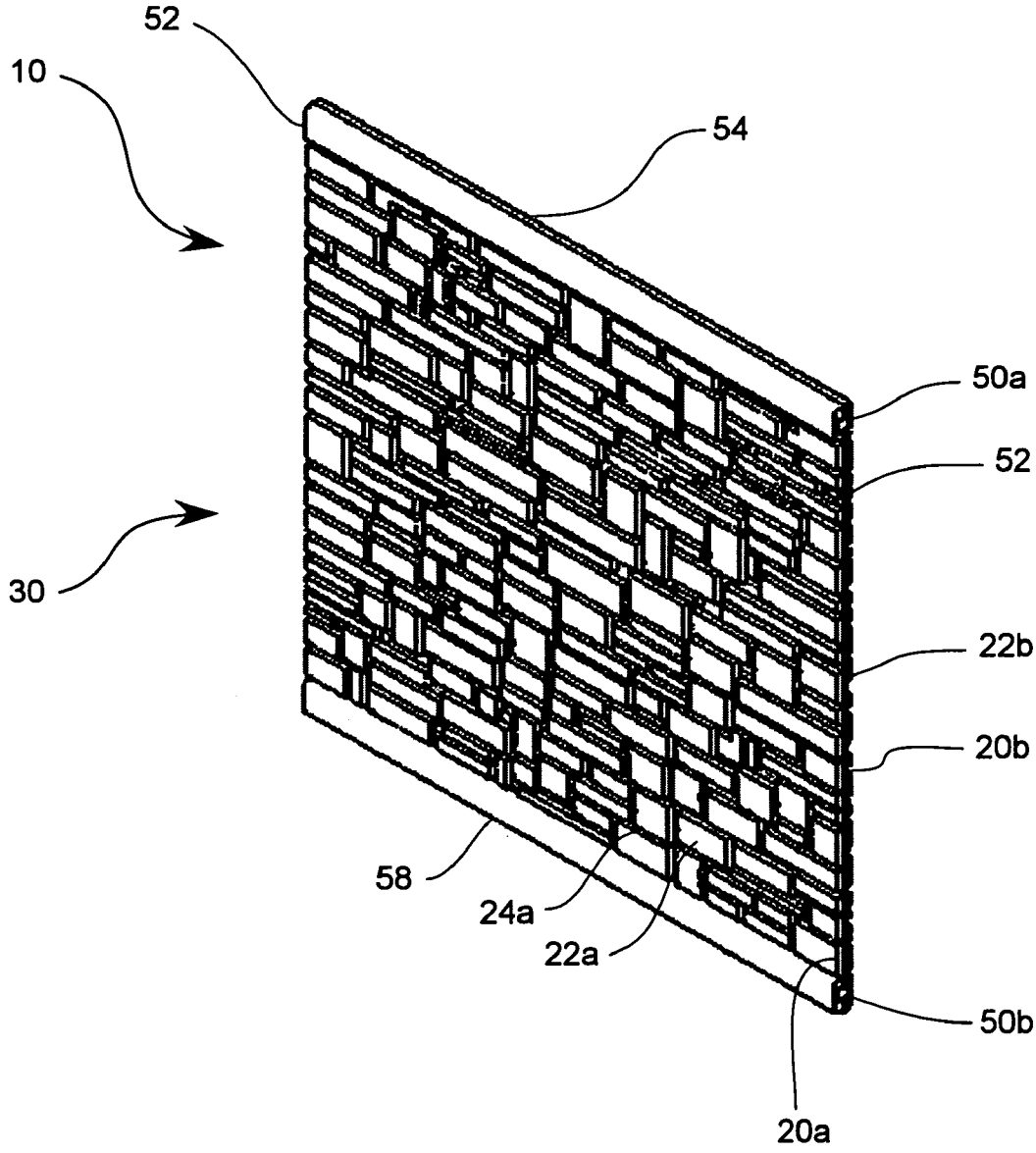
FIG. 1 is a perspective view of decorative fence panel in accordance with an embodiment of the present invention.
Figure 2:
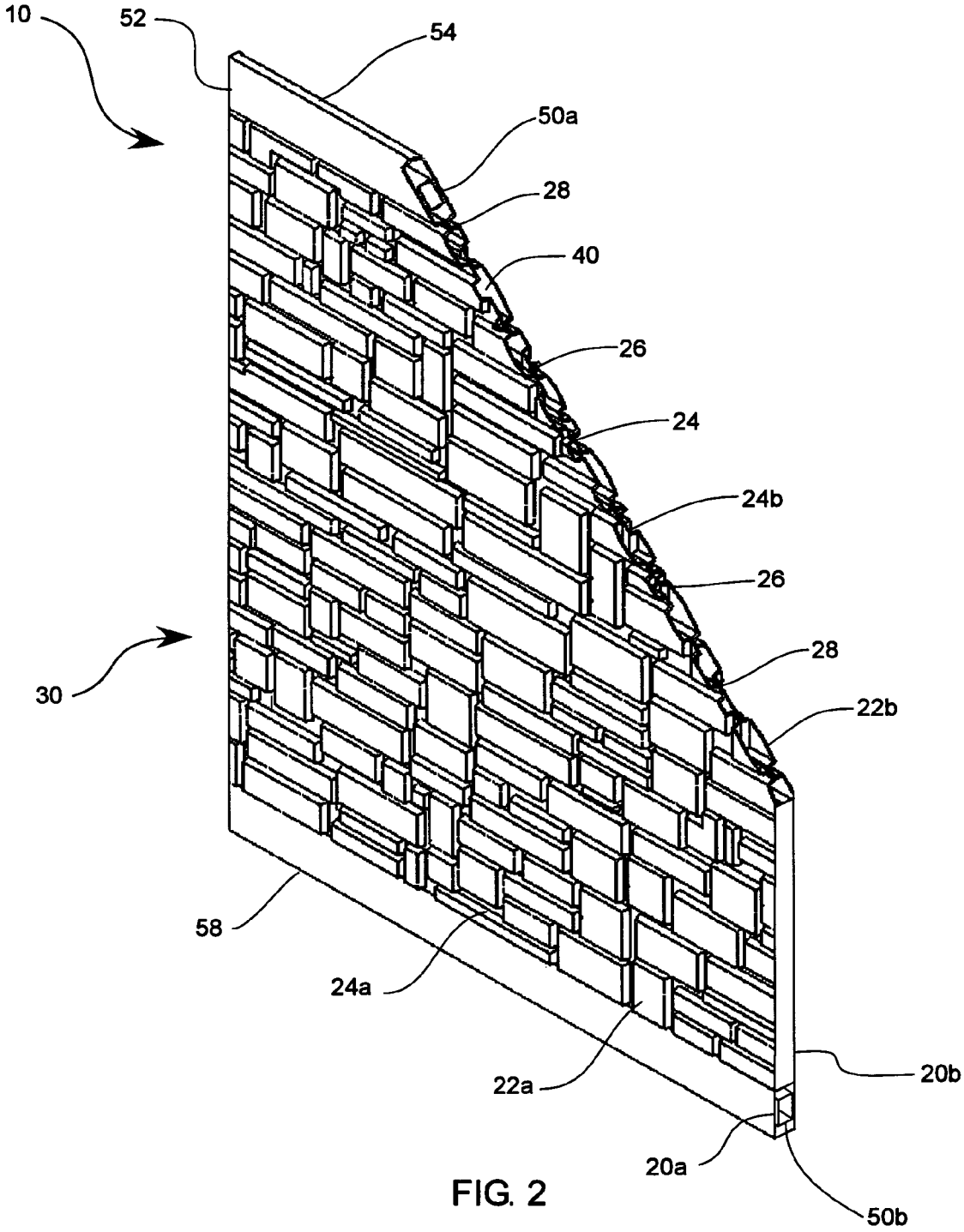
FIG. 2 is a perspective cut-away view of the decorative fence panel of FIG. 1.
Figure 3:
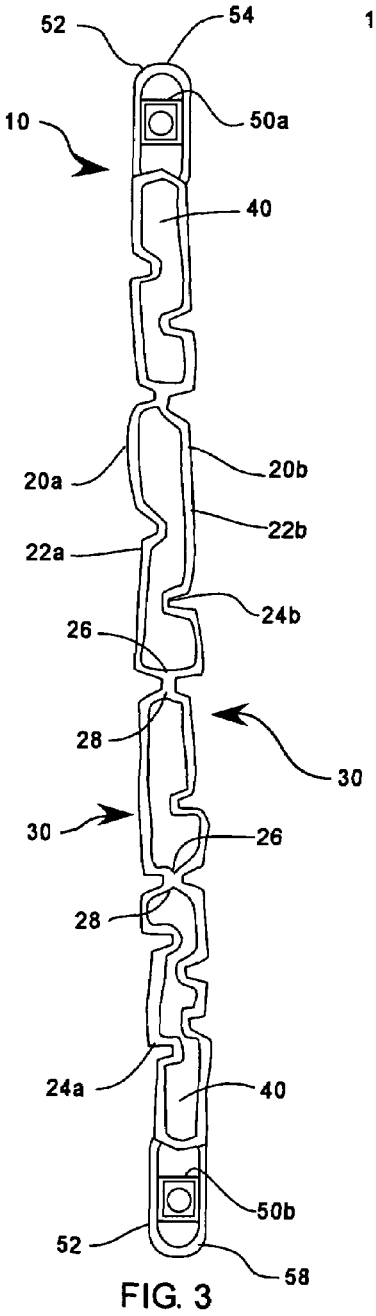
FIG. 3 is cross sectional view of the decorative fence panel of FIG. 1.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention provides for a decorative fence panel that is molded from a polymeric resin to simulate another fencing material such as rock, stone, or wood or the like. The panel is configured to fit between two decorative posts that can have the same pattern or a complementary pattern to the panel. The panel can be substantially hollow between two opposite plastic walls, but the walls can indent into the hollow space toward the opposite wall to form a grid of traversing channels simulating grout lines, slat lines, or the like, on each wall. These channels intersect inside the hollow space at select locations to form a grid of nodes of continuous polymeric resin material that criss-cross throughout the hollow space and across the panel. The nodes form thermal pathways and facilitate thermal conduction between the two walls to resist differential thermal loads, and thus warping of the panels. The nodes also form structural connections between the opposite walls. The grids of traversing channels also break-up the broad surface of the walls to allow discrete and/or isolated thermal expansion between the channels to further resist warping (like an "accordion effect"). The posts have at least one vertical groove extending substantially the length of the post. The decorative panel is slid into the groove on the post after the post is secured to a surface. The decorative panel can be retained in the groove by gravity alone, and substantially no mechanical fasteners are needed to secure the panel. The groove is sized to accommodate thermal expansion of the panel.

As illustrated in FIGS. 1-4, the decorative fence panel, indicated generally at 10, in accordance with the present invention is shown. The decorative fence panel 10 has two opposite plastic walls 20*a* and 20*b* (perhaps best seen in FIGS. 3 and 4). The opposite walls 20*a* and 20*b* have opposite facing exterior surfaces 22*a* and 22*b* that can be substantially spaced apart from one another. In one aspect, the opposite surfaces 22*a* and 22*b* can be spaced apart less than approximately two to three inches, such that the panel 10 has a thickness less than approximately two to three inches.

The decorative fence panel 10 can be sized to accomodate standard sized fences. In one aspect the decorative fence panel 10 can be approximately 6 feet high by 6 feet wide, such that the panel can be used in a 6 foot high fence. In another aspect the panel can be approximately 3 feet high and 6 feet wide and can be used in a 3 foot high fence. Advantageously, because the decorative fence panel 10 is a polymeric resin or plastic, the panel can be cut to fit into fencing applications that are smaller than the size of the panel. Additionally, because the decorative fence panel 10 can be cut to a desired size or shape, the panel is particularly suited to fencing uneven terrain. In cases of uneven terrain, such as sloped elevations or unmovable obstacles, the bottom of the decorative fence panel 10 can be cut to accommodate the terrain and the top remains aesthetically pleasing and similar to adjacent fencing. The panels can be cut without substantially affecting any physical properties such as strength, stiffness, rigidity, or heat transfer properties, of the panel.

Each of the opposite walls 20*a* and 20*b* has a grid of traversing elongated channels 24*a* and 24*b* formed by inward deflections in the walls, or each wall 20*a* and 20*b* bending inward towards the opposite wall. The walls 20*a* and 20*b* can have a substantially constant thickness across the panel, and can bend or deflect inwardly to form the channels. Each grid has channels that traverse, intersect, and/or cross one another. The grids, or channels forming the grids, can be irregular to form protrusions therebetween that simulate other fencing materials, as discussed below. In addition, the channels can have different and/or irregular lengths to further form protrusions that simulate other fencing materials. The channels themselves can simulate grout or mortar lines. Furthermore, each individual channel can be discontinuous across the panel. Thus, the channels break-up the broad surface of the panel to isolate thermal expansion, as discussed below.

The grids or traversing channels 24*a* and 24*b* define a decorative profile of a fence, indicated generally at 30. The decorative profile 30 and/or the grids of traversing channels can simulate a fencing material, such as stone (as shown), rock, brick or wood. The walls can have any decorative profile, or can simulate any fencing material. The decorative profile 30 can simulate a fence material such as brick, stone, rock, wood, vinyl, slats, log poles, herringbone, lapped wood, cedar slats, river rock, wrought iron, simulated wood, simulated rock, simulated stone, simulated brick, and lava rock. Additionally, the decorative profile 30 can simulate a combination of fence materials. For example, the bottom half of a panel may simulate rock while the top half may simulate wood slats extending upward from the rock. Protrusions can be defined between the channels that are larger than the channels, or that are wider and longer than the width of the channels. The protrusions can simulate a fencing material like bricks, stone or rock, while the channels can simulate grout or mortar between the bricks, stones or rocks, as shown. Alternatively, the protrusions can simulate wood slats, while the channels can simulate gaps or slat lines between the wood slats. It will be appreciated that the protrusions can have an exterior surface that is textured, or that itself contains indentations and protrusions to simulate a fence material.

The grid of traversing channels 24 can be shaped and sized to simulate grout lines, mortar lines, or slat lines between protrusions on the decorative fence panel that simulate rock, stone, brick, wood, vinyl, or the like. In one aspect, the elongated channels 20 can be substantially linear, can be oriented substantially horizontally and vertically, and can intersect one another at substantially right angles to simulate grout lines between slate stone or quadrangular shaped rock. In another aspect, the elongated channels 20 can be curvilinear and can intersect one another at oblique angles to simulate grout lines between semi-spheroidally shaped rocks, such as river rock. The channels can be elongated and straight, and can be oriented horizontally and vertically, as shown, to simulate grout lines between protruding quadrangular stone. In addition, the channels are discontinuous across the panel, and have different lengths to define protrusions between the channels that simulate a fencing material such as stone, brick, wood or the like. Alternatively, the channels can be arcuate, and can define rounded protrusions, to simulate rock. It will be appreciated that numerous configurations are possible to simulate numerous fencing materials.

The opposite facing exterior surfaces 22*a* and 22*b* of the opposite walls 20*a* and 20*b* can also have different decorative profiles 30 with respect to one another so that each side of the decorative fence panel 10 can simulate a different fence material. For example, the exterior surface 22*a* of one wall 20*a* could simulate rock, while the exterior surface 22*b* of the opposite wall 20*b* could simulate vinyl fencing. In this way, the decorative fence panel can be used to augment an existing fence on one side of a fence line and a different fence on the other side of the fence line. Advantageously, this allows owners of adjacent property to share a common fence line, but each have a distinctive appearance on the fence facing their property.

The grid of traversing channels 24*a* and 24*b* can also form a plurality of separate and discrete physical connections 26 between the opposite walls 20, or inside the panels. The connections 26 can be spread across, or be disposed across, the decorative panel 10. The connections 26 can be formed by select intersections of the inward deflections that form the grids of traversing channels 24*a* and 24*b* in the opposite walls 20*a* and 20*b*. Specifically, a wall 20*a* bending in towards the opposite wall 20*b* and forming a channel 24*a* can intersect another channel 24*b* bending in from the opposite wall 20*b*. This intersection forms a continuous material node 28 that can have the same material composition as the opposite plastic wall, and is continuous throughout the node 28. A plurality of these intersections can form a plurality of continuous material nodes 28 that are spread across, or are disposed across, the decorative panel 10 between the opposite walls 20*a* and 20*b*. These continuous material nodes 28 can have a thickness between opposite facing exterior surfaces 22 of approximately one to two times the thickness of the opposite plastic walls 20. It has been found that such a thickness facilitates manufacturing of the nodes and the panels, while maintaining a sufficient thickness of the material to avoid thin or translucent spots in the panel.

Advantageously, the continuous material nodes 28 can help in controlling internal forces on the panel 10. In particular, the nodes 28 can form thermal energy transfer paths between the opposite walls 20*a* and 20*b* to transfer thermal energy between the opposite walls. Thus, as one wall is heated or cooled, such as by direct sunlight, the thermal energy is transferred through the thermal energy pathway to the opposite wall. In this way, the continuous material nodes 28 can transfer heat from one wall 20*a* to the other wall 20*b* to resist differential thermal expansion between the opposite walls, and thus reduce or resist warping of the decorative fence panel 10.

The grid of traversing channels 24*a* and 24*b* and the continuous material nodes 28 also provide an "accordion" like structure that attenuates the effects of thermal expansion within a wall 20*a* or 20*b*. In particular, the grid of traversing channels disrupts the plane of each of the walls so that thermal expansion in the planar direction of the wall is disrupted and localized, as opposed to extending over an entire length or width of the wall. Furthermore, the expansion that does occur over each individual portion of the wall is deflected, or absorbed, by the adjacent grid of traversing channels, and thus overall expansion across the entire wall is much less than if the wall was a single planar sheet, or extended continuously from one side to the other. Advantageously, this deflection effect minimizes warping of the wall, and also the panel 10, during the high heat conditions of the panel forming process. Additionally, the deflection effect minimizes warping or deformation from smaller thermal changes caused by changes in ambient temperatures, as well as thermal differentials across the panel 10 caused by direct sunlight on one portion, or side, of the panel 10 and shadows on another portion.

The grid of traversing channels 24*a* and 24*b* and the continuous material nodes 28 also stiffen and strengthen the opposite walls 20*a* and 20*b* by introducing orthogonal prestressed planar deflections and mechanical connections between the walls. These deflections and mechanical connections enhance the rigidity and strength of the panel 10 resulting in a two wall panel that is less susceptible to a vibrational "drum" effect between the walls. Advantageously, the increased strength and rigidity of the panels 10 that is created by the grids of traversing channels 24*a* and 24*b* and the continuous material nodes 28 make the panel 10 highly resistant to normal, perpendicular, or transverse loads caused by wind or physical collision or impact with the walls 20*a* and 20*b*.

The connections between the opposite walls 20*a* and 20*b* are discontinuous across the walls, or the panel. Thus, at least one continuous, non-linear space 40 can be formed between the opposite walls 20*a* and 20*b* by the continuous material nodes 28. Thus, the continuous material nodes 28 can close off select portions between the two walls, but leave a continuous, non-linear, or labyrinth-like space between the opposite walls 20 that is open across the entire panel 10. The continuous space can facilitate manufacture, such as by roto-molding. The continuous, non-linear space 40 between the opposite walls 20*a* and 20*b* can be hollow, or the space 40 between the opposite walls 20*a* and 20*b* can be empty. It has been found that a hollow panel is sufficiently strong, and is believed to reduce manufacturing costs. In another aspect, the space 40 between the opposite walls 20*a* and 20*b* can contain a filler material. The filler material can be an insulating material such as glass, foam, spun fiber, or mixtures of these materials. The filler material can also be a structural material such as grout, aggregate, sand, concrete, and mixtures of these materials. Other materials such as liquids can also fill the space between the opposite walls. Such fillers can dampen sound, provide structural rigidity or stiffness, etc.

Figure 4:
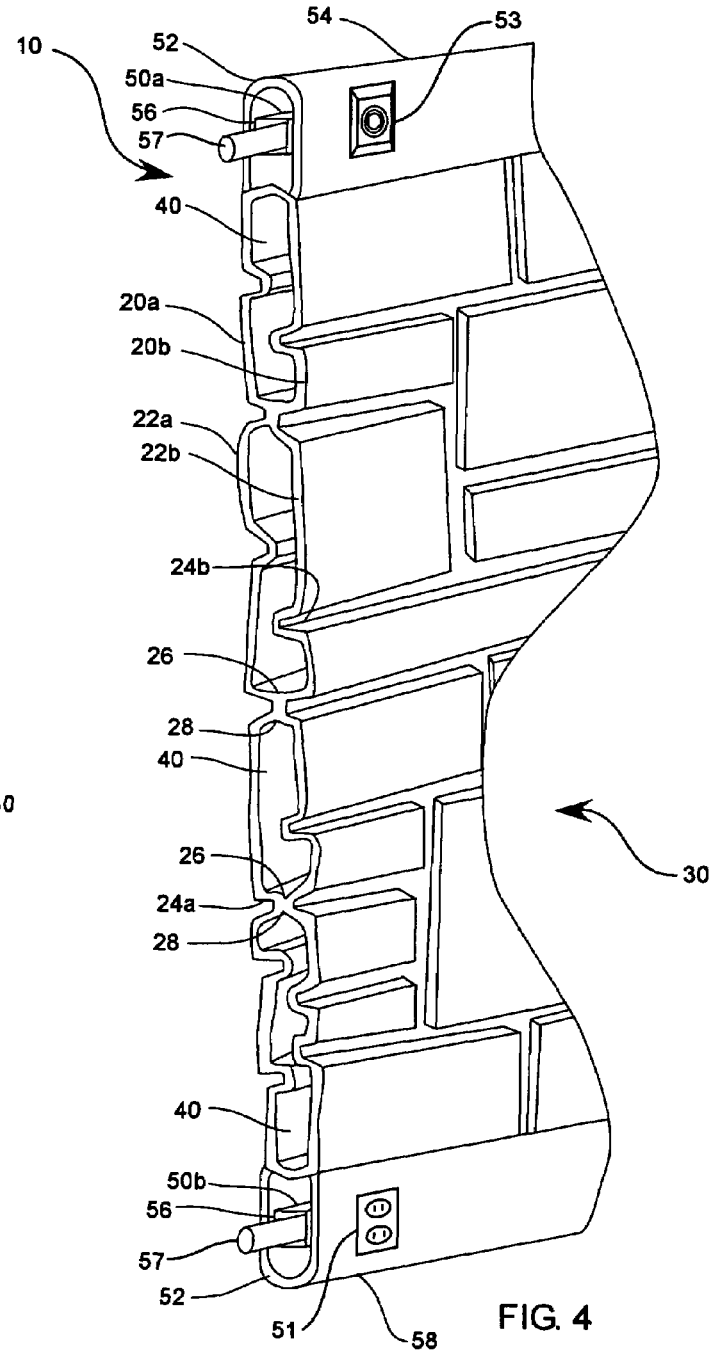
FIG. 4 is a partial perspective view of the decorative fence panel of FIG. 1.

An elongated insert 50*a* can extend longitudinally along a top 54 of the decorative fence panel 10 between the opposite walls 20*a* and 20*b*. Another elongated insert 50*b* can extend longitudinally along a bottom 58 of the decorative fence panel 10 between the opposite walls 20. The elongated inserts 50 can have opposite ends 56 that extend beyond the perimeter 52 or lateral edges of the decorative panel 10, or the walls 20*a* and 20*b*, as shown in FIG. 4. These elongated inserts 50 can reinforce the decorative panel 10 and strengthen the panel against normal or perpendicular forces, such as wind.

The inserts 50*a* and 50*b* can be disposed in elongated hollows in the panel, and can be maintained therein without any fasteners or adhesive so that the panel or walls can expand and move along the inserts during thermal expansion. The inserts 50*a* and 50*b* can be single, continuous members. In one aspect, the inserts can be formed of metal, such as galvanized steel or aluminum. In another aspect the inserts can be made of composite, wood, or plastic materials. The panel can have elongated protrusions along the top and bottom to accommodate the inserts therein.

Advantageously, the elongated inserts 50*a* and 50*b* can provide a continuous tube through out the length of the panel 10 and adjoining panels. Thus, the elongated inserts 50*a* and 50*b* can form conduits throughout a fence that can facilitate various utility lines 57, such as electrical power wires, phone wires, data communication wires, gas piping, water piping, or other similar utility lines. In this way, the decorative fence panel 10 of the present invention can provide access to various utilities throughout the fenced area. The decorative fence panels 10 can have suitable warning labels molded or affixed thereto, in order to warn of the presence of utility lines within the fence.

In the case where the elongated inserts 50*a* and 50*b* house electrical line, the elongated inserts can be electrical conduit that is fully compliant with existing building codes, as known in the art. The elongated inserts 50 and 50*b* can house high voltage or low voltage electrical lines. Additionally, electrical receptacles can be formed in the decorative fence panel adjacent the elongated inserts 50*a* and 50*b* and can hold electrical sockets, plugs 51, or decorative lighting fixtures 53. In one aspect the decorative fence panels 10 can be pre-wired at the time of manufacture and shipped in a ready-to-install configuration. In another aspect the electrical lines and fixtures can be wired into the decorative fence panel at the time of installation by a qualified electrician.

The decorative fence panel 10 or walls 20*a* and 20*b* can be formed by a molding process, such as rotational molding, or roto-molding. Additionally, the opposite walls 20*a* and 20*b* with the grids of traversing channels 24*a* and 24*b* and the continuous material nodes 28 can be formed by blow molding, injection molding, gas assist injection molding, water assisted injection molding, vacuum molding, compression molding, pultrusion or combinations of these processes, as known in the art. The decorative fence panel 10 can also be formed by a plastic forming process such as thermoforming, twin sheet thermoforming, extrusion forming, and combinations thereof. Other composite processes might be utilized, such as VARTM, RTM, hand layups, bulk molding compound, sheet molding compound, etc.

The opposite plastic walls 20*a* and 20*b* can be made from a polymeric resin material such as thermoplastic or thermoset resin, and/or can be made from olefins, styrenes, nylons, or mixtures of these polymeric families. In one aspect, the opposite plastic walls can be formed from an olefin, such as ploy-ethylene or polypropylene, or the like. In another aspect, the opposite plastic walls can be formed from a styrene, such as acrylonitrile or butadiene styrene, or the like. In still another aspect, the opposite plastic walls can be formed from a mixture of olefins and styrenes. The polymeric resin material can also be made from recycled olefin, styrene, or nylon products. It will also be appreciated that the material of the walls can include additives, such as glass, fiber, talc, UV resistive or protective materials, etc. In one aspect, plastic granules of different colors can be combined to obtain a wall color that is a composite color to more readily simulate another material.

The opposite walls 20*a* and 20*b* can have a constant material composition from one exterior surface 22*a* to an interior surface. Advantageously, a constant material composition throughout the wall 20 maintains the pleasing aesthetic appearance of the wall 20*a* and 20*b* in the case where the wall is dented, nicked, scratched, cracked, or otherwise damaged. In such instances, the color of the wall underneath the exterior surface is the same as the color and composition of the wall on the exterior surface. Consequently, damage to the exterior surface is less noticeable than the case where the wall is superficially coated on its surface with a texturizing material or colorant.

Colorants may be added into the molding or forming process to color the wall to any desired color. In this way, the simulation of rock, brick, wood or other fence material can be made to appear more realistic. Additionally, the channels 22*a* and 22*b* can be formed of a different color and/or material than the protrusions between the channels that simulate the fencing material. Thus, the channels can be made to appear as more realistic grout, mortar, or slat lines in a fence. Additionally, the channels and protrusions can be the same material and color. It has been found that the shadow created in the channels provides a sufficient contrast to the protrusions to create a grout looking appearance sufficient to meet many cosmetic purposes.

There are several additional advantages to using a molded polymeric resin to form the decorative fence panel 10 of the present invention. For example, polymeric resin fence panels have a high strength to weight ratio, so that they are light in weight but very strong. Moreover, additional additives can be added to the polymeric resin during the forming process of the fence panel to improve the properties of the fence. For example, impact modifiers such as chopped fibers, glass microspheres, talc, woodflour, crushed walnuts, or the like, can be added to improve the physical properties of the fence, such as the impact resistance of the panels. Additionally, anti-microbial chemicals can be added to resist the growth of mold or other microbial contaminants on the fence panel during use. Furthermore, ultra-violet inhibitors can be added to protect the polymeric resin from damage due to ultra-violet sun rays. Other additives can be added to achieve desired properties of a fencing system, as known in the art.

Figure 5:
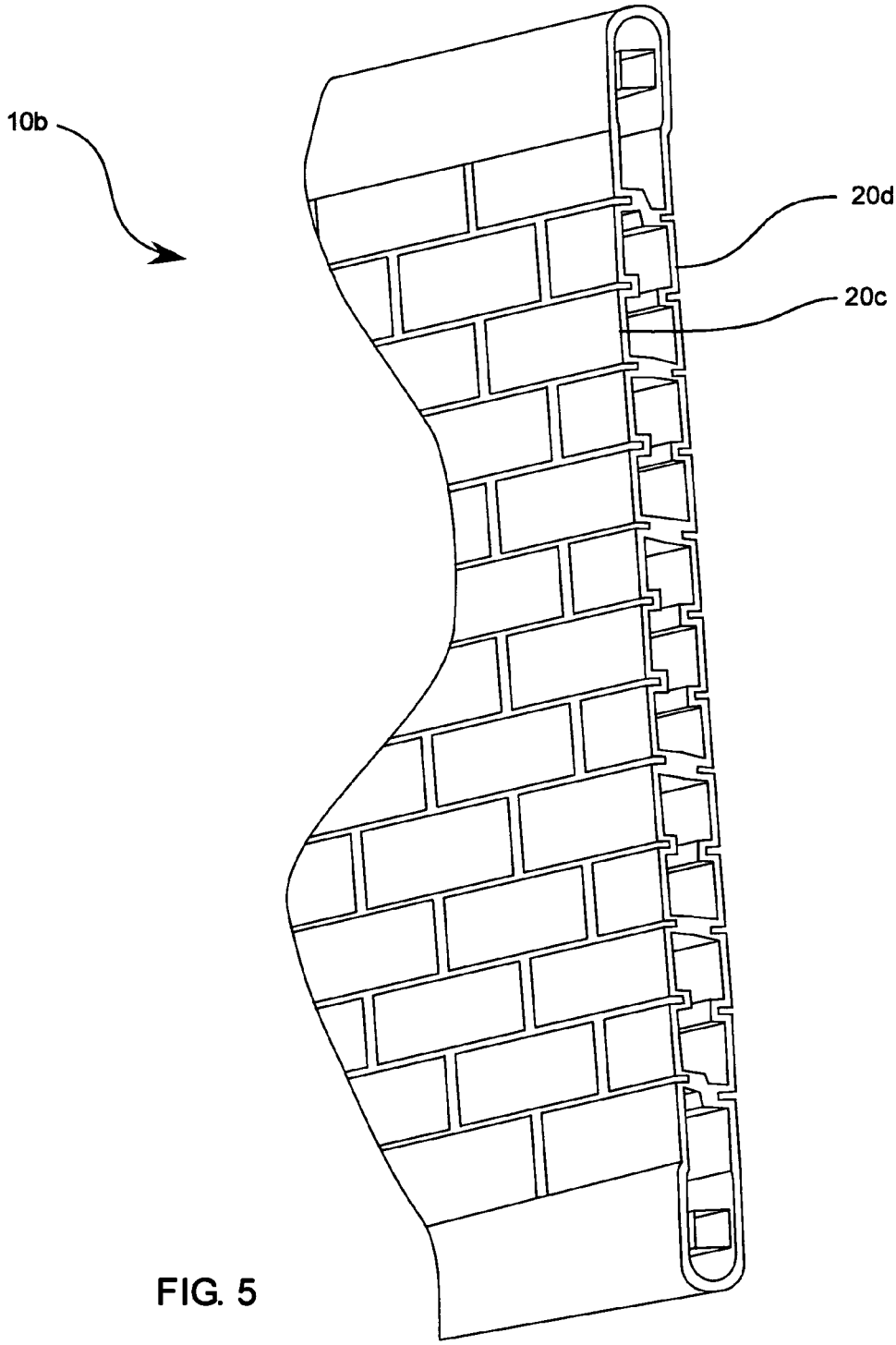
FIG. 5 is a partial perspective view of the decorative fence panel of FIG. 1 with a different decorative profile.
Figure 6:
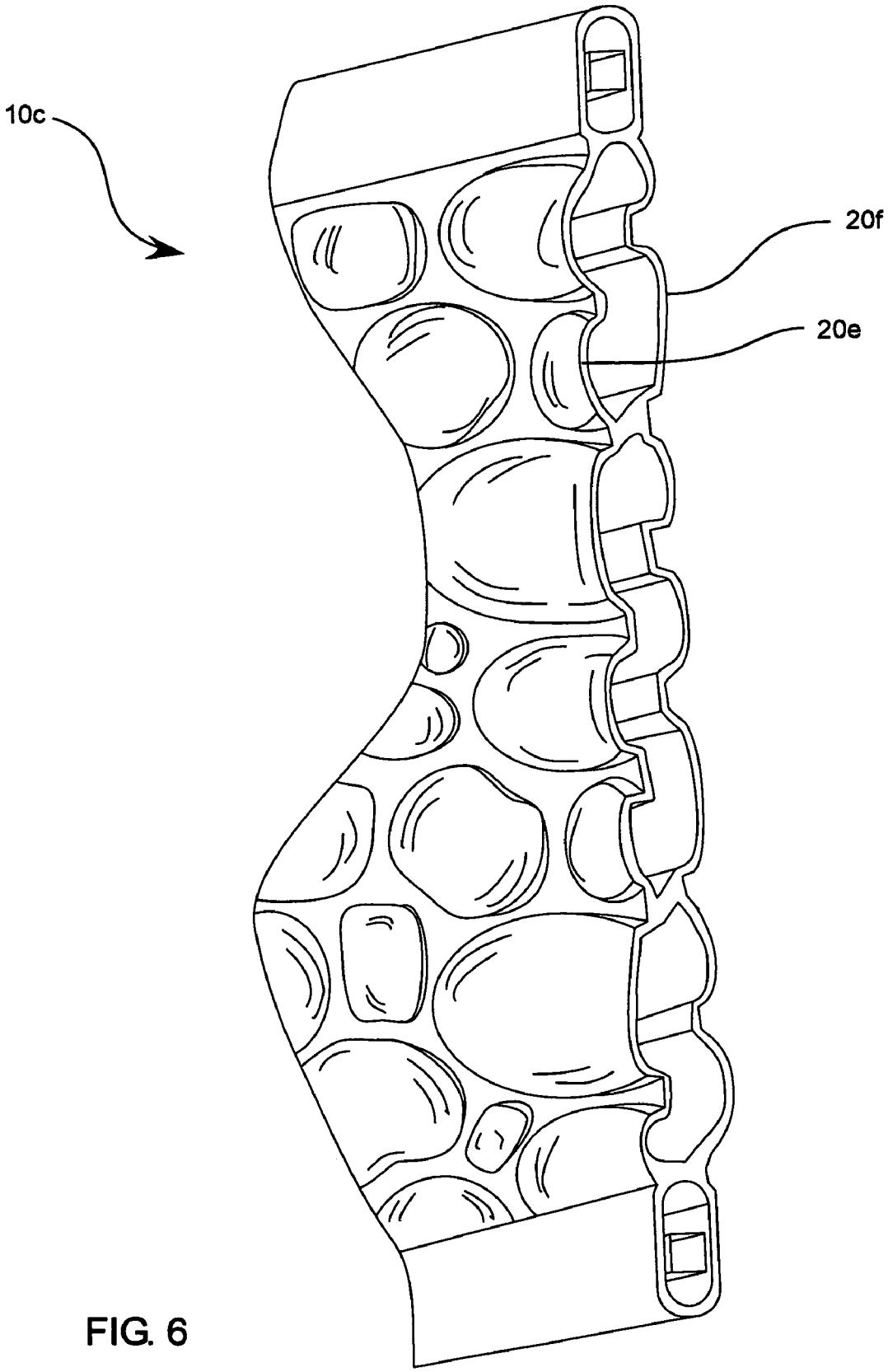
FIG. 6 is a partial perspective view of the decorative fence panel of FIG. 1 with a different decorative profile.
Figure 7:
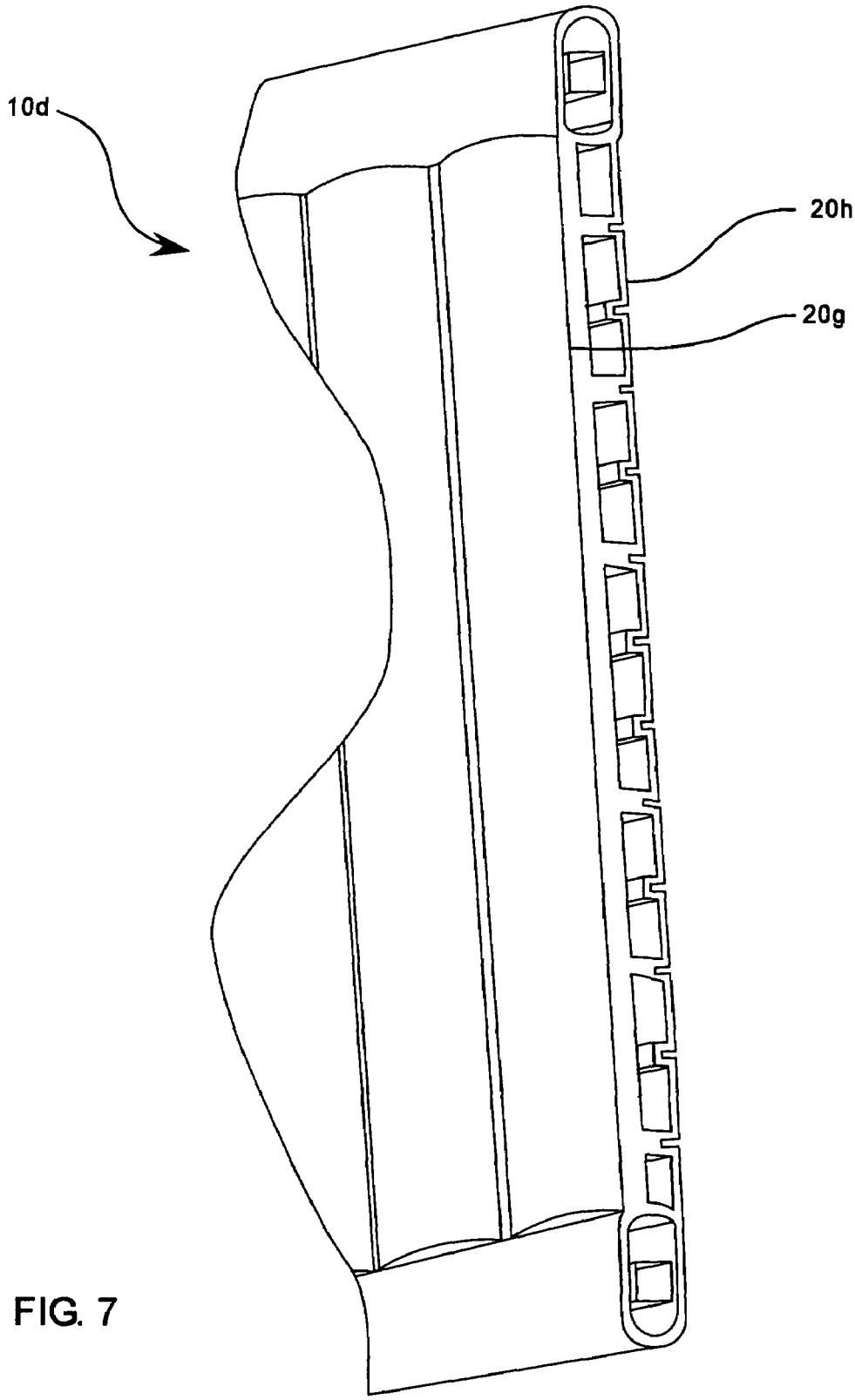
FIG. 7 is a partial perspective view of the decorative fence panel of FIG. 1 with a different decorative profile.

As illustrated in FIGS. 5-7, the decorative fence panels 10 can simulate a variety of common fencing materials, as described above. FIG. 5 shows the decorative fence panel 10*b* with opposite walls 20*c* and 20*d* simulating brick. FIG. 6 illustrates a decorative fence panel 10*c* with opposite walls 20*e* and 20*f* simulating semi-spheroidal stones, such as river rock. FIG. 7 illustrates a decorative fence panel 10*d* with one wall 20*g* simulating vertical slats, such as cedar slats, and the opposite wall 20*h* simulating brick.

Figure 8:
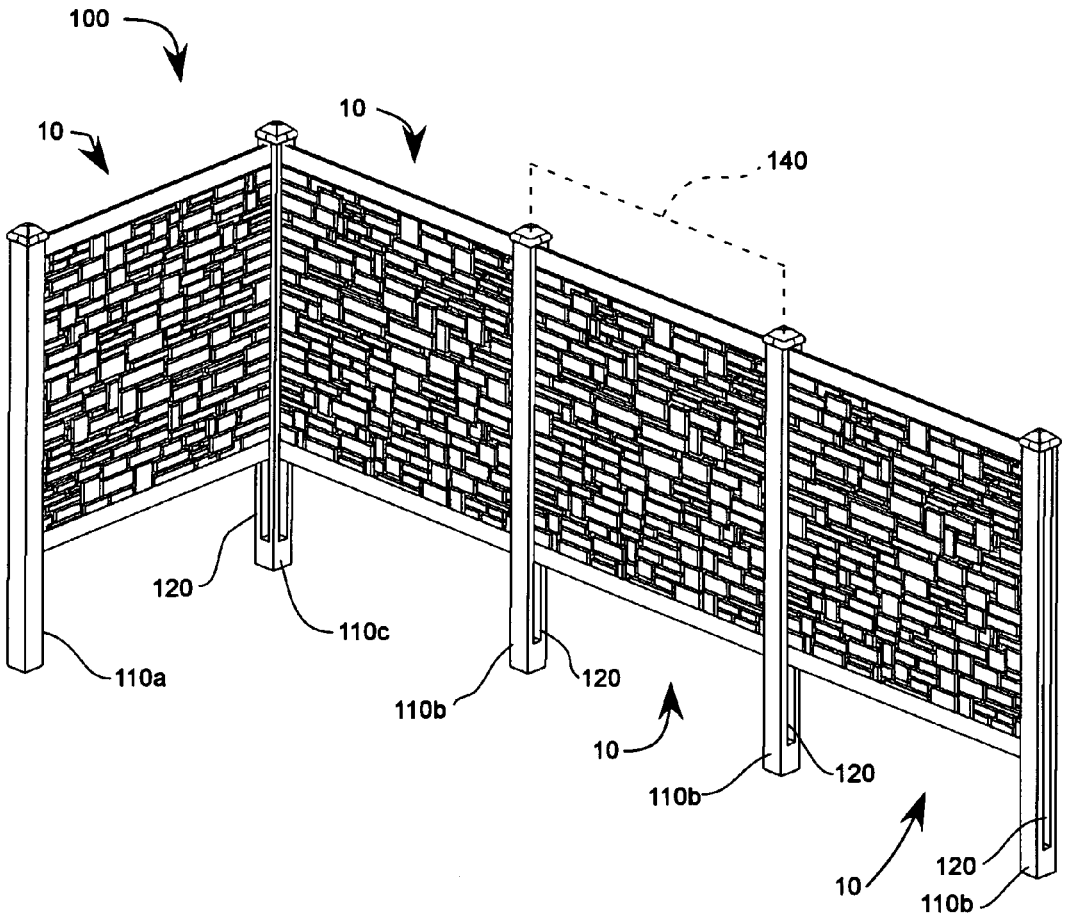
FIG. 8 is a perspective view of a fence system using the decorative fence panel of FIG. 1.
Figure 9:
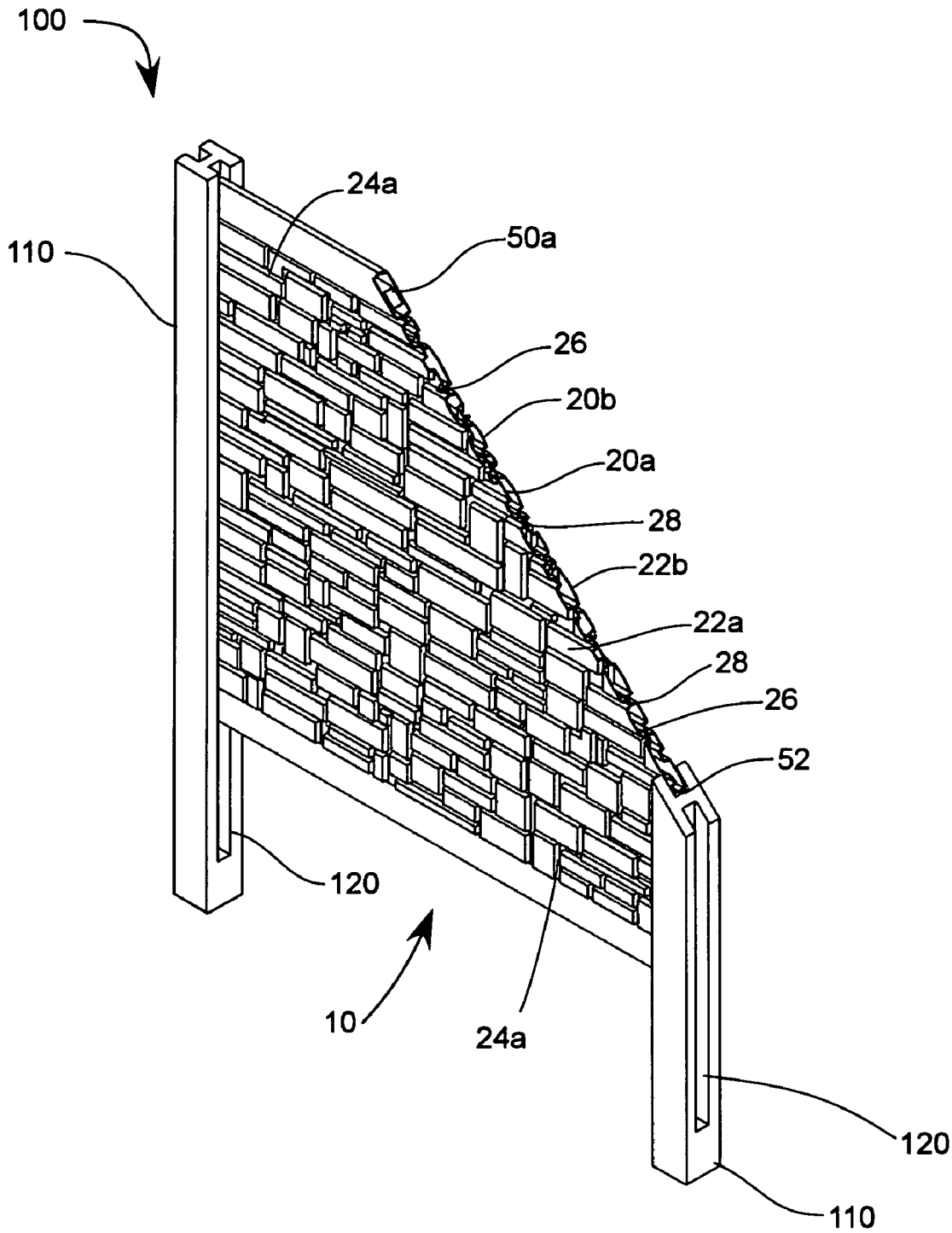
FIG. 9 is a partial perspective view of the fence system of FIG. 5.
Figure 10:
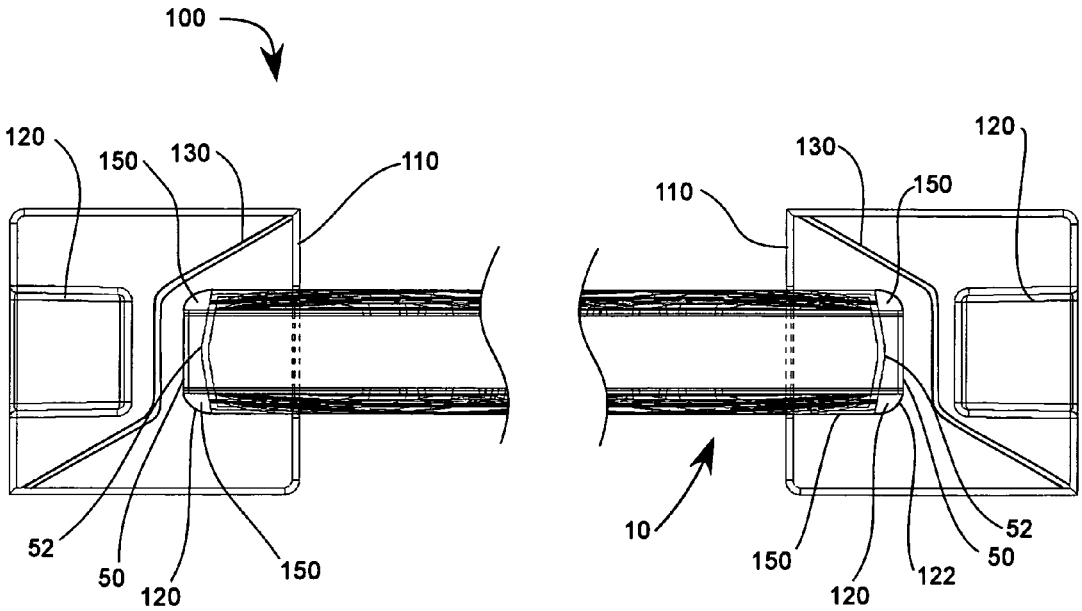
FIG. 10 is partial top view of the fence system of FIG. 5.
Figure 11:
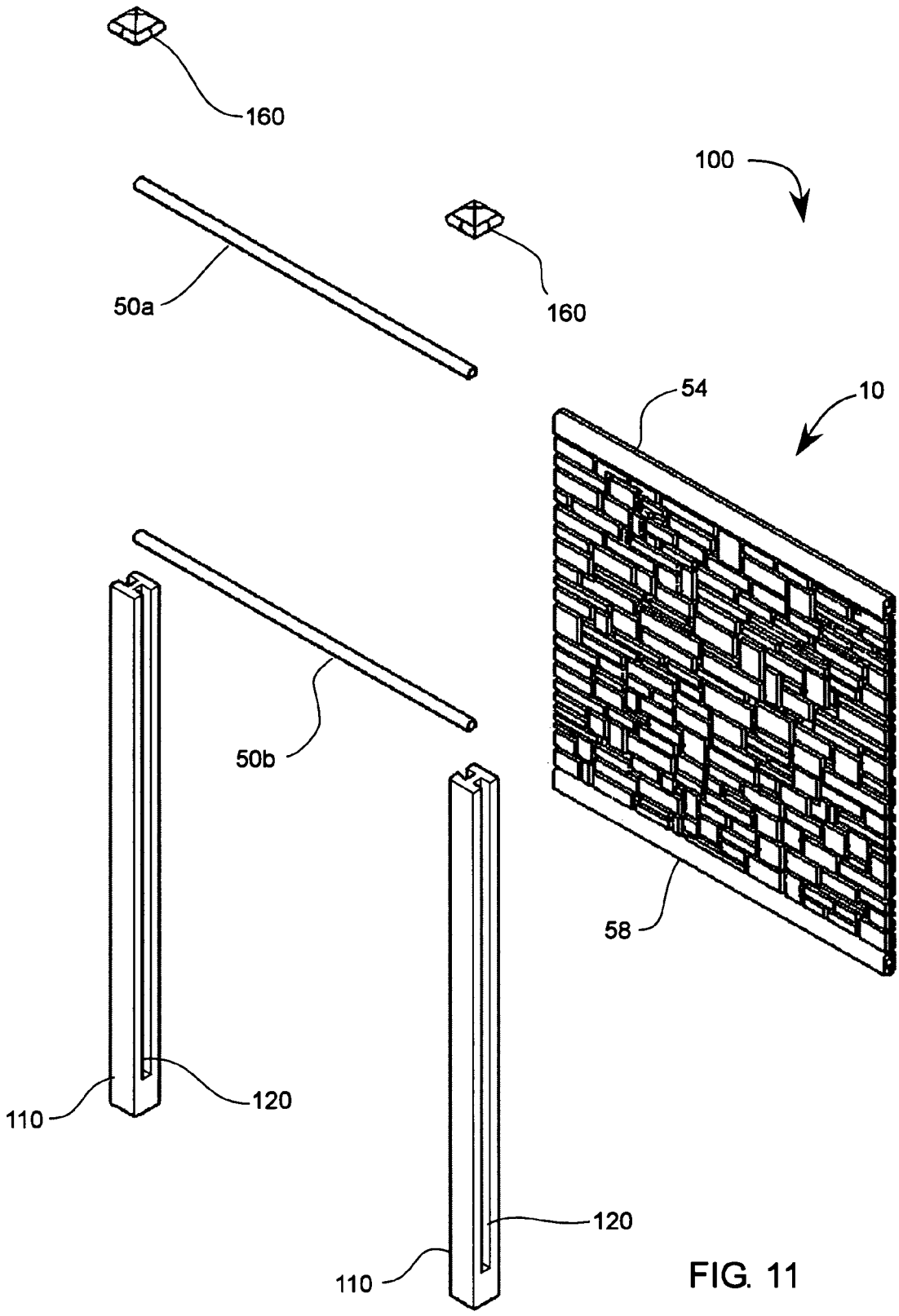
FIG. 11 is a perspective exploded view of the fence system of FIG. 5 and shows the method of installing the fence system.
Figure 12:
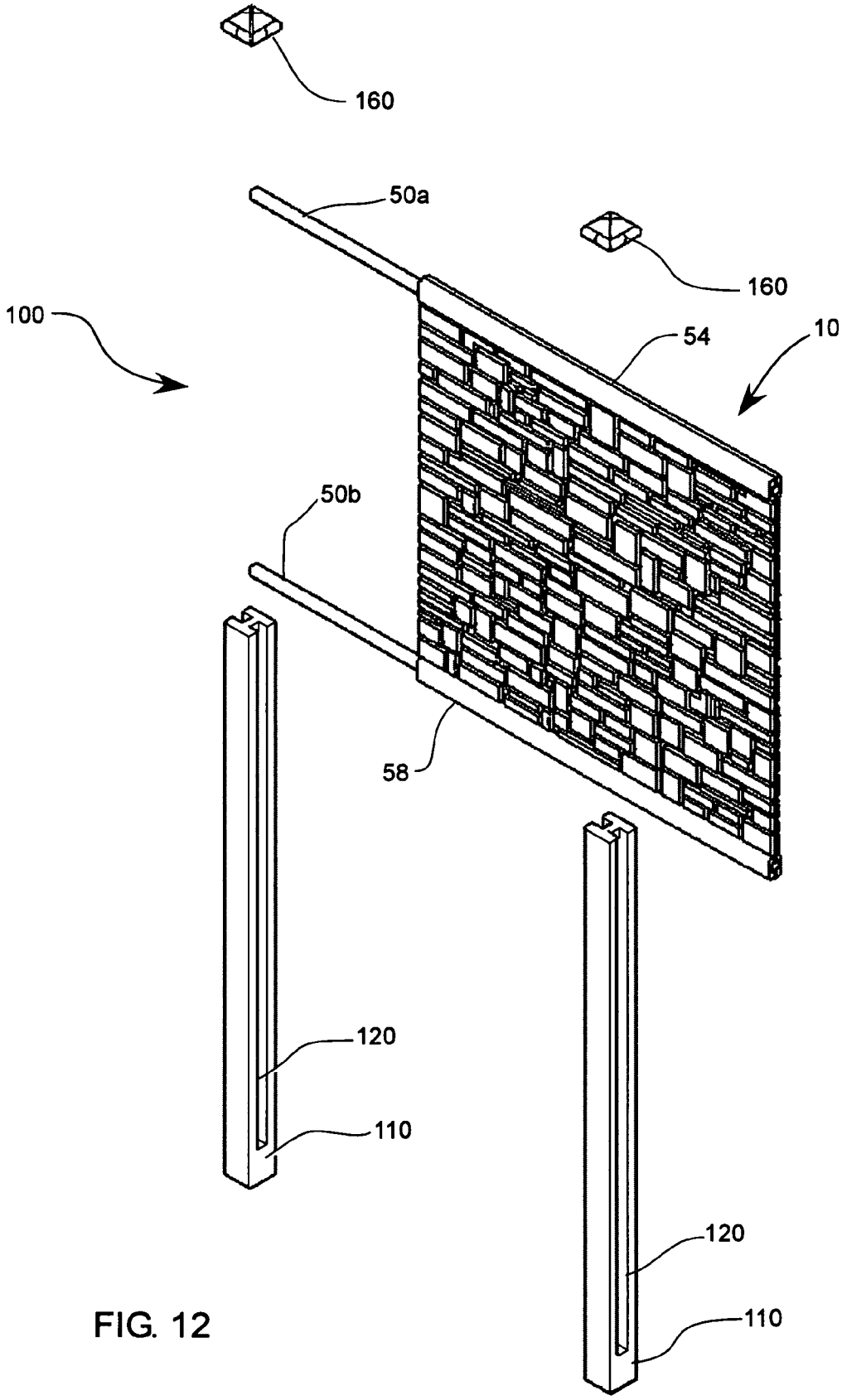
FIG. 12 is a perspective view of the fence system of FIG. 5 in a partially installed configuration.
Figure 13:
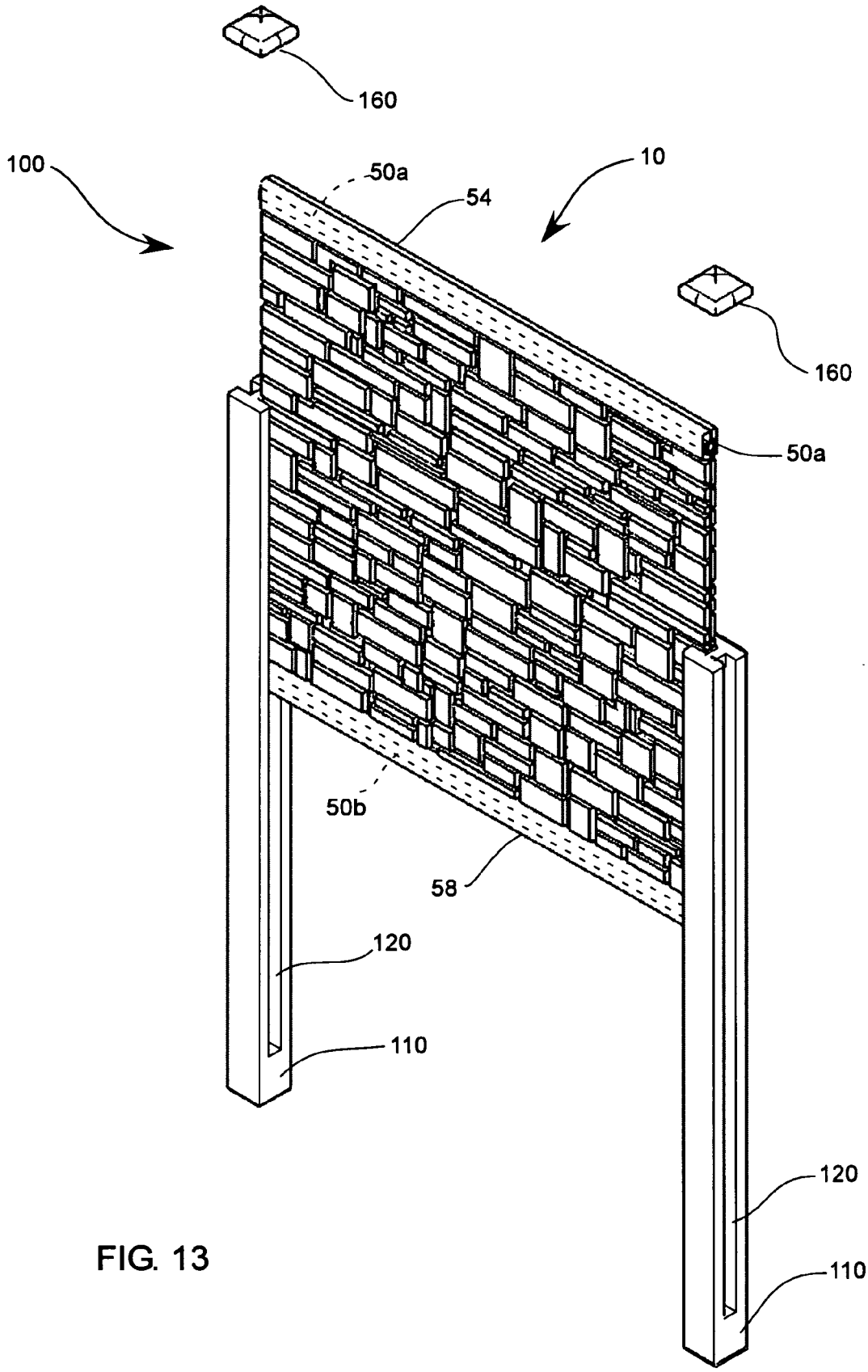
FIG. 13 is a perspective view of the fence system of FIG. 5 in a partially installed configuration.
Figure 14:
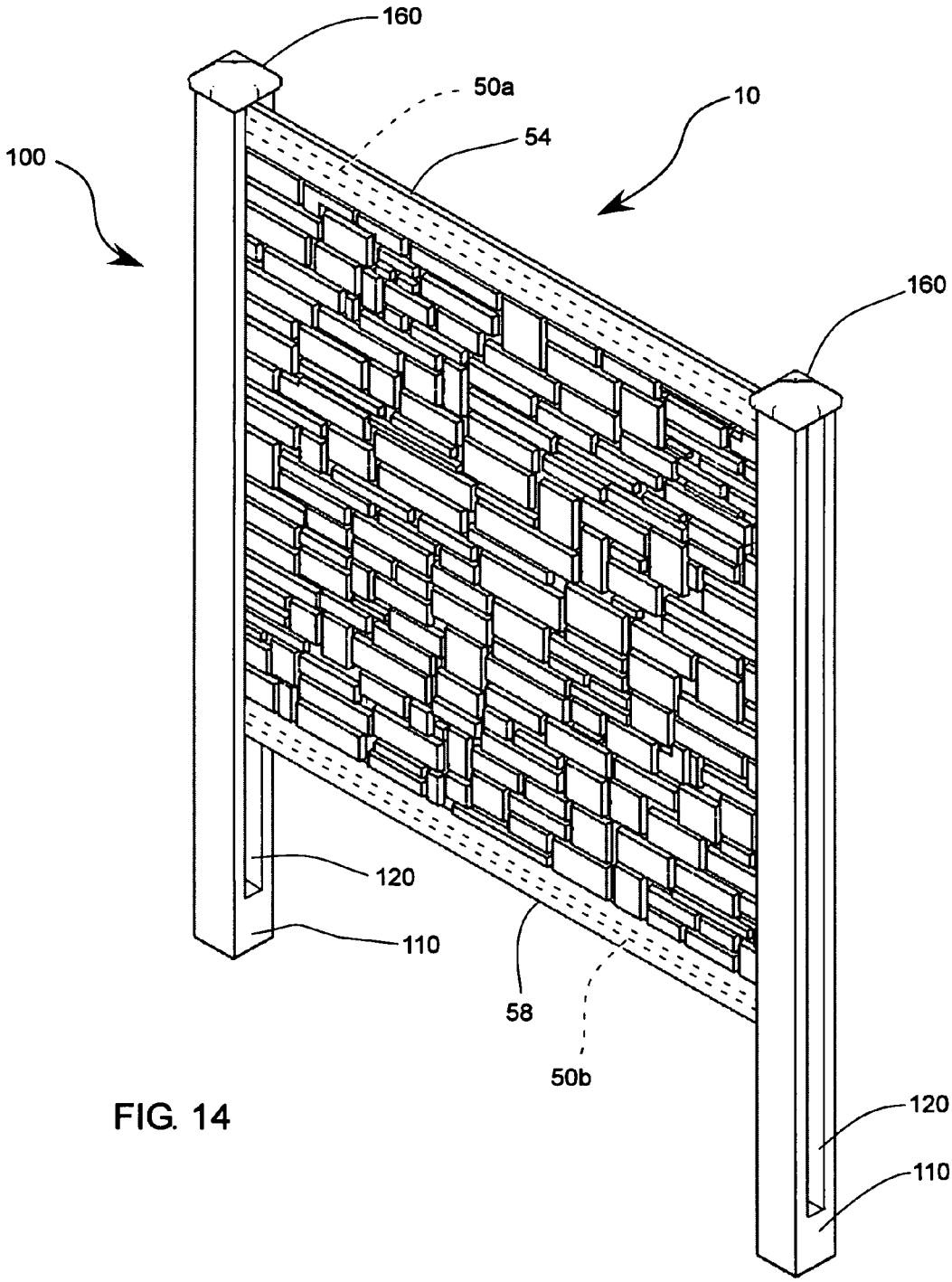
FIG. 14 is a perspective view of the fence system of FIG. 5 in an installed configuration.

Turning now to FIGS. 8-10, a plurality of decorative fence panels 10 in accordance with an embodiment of the present invention used in a fencing system, indicated generally as 100, is shown. The fencing system 100 has a plurality of decorative posts 110 that can be secured to a support surface, such as being buried in the ground, or attached to a concrete slab. The decorative posts 110 can have plastic walls made from a polymeric resin similar to the decorative fence panels 10. The plastic walls can be continuous around a perimeter of the post 110 and the post can be substantially hollow within the plastic walls, or can include inserts and/or foam. The plastic walls can simulate a similar fencing material to the decorative fence panels, or a complementary fencing material.

A foam material or other filler material, as known in the art, can be disposed within the hollow space to stiffen and strengthen the posts. Additionally, the posts can be formed to slip over the top of existing fence posts such as metal chain link poles, four inch by four inch wood or vinyl poles, metal stake poles, or the like. In the case where the post is used to cover an existing fence post, such as a metal chain link pole, sufficient support structure can be disposed inside the plastic walls to secure the plastic walls to the existing post. For example, the posts can have an elongated vertical cavity extending from the bottom so that the posts can slip over an existing post. The posts 110 can have sufficient length to support a 3 or 6 foot high fence, or other sized fences, as known in the art.

The decorative posts 110 can be formed by a molding process, such as rotational molding, or roto-molding, similar to the decorative fence panels 10 described above. Additionally, the posts 110 can be formed by blow molding, injection molding, gas assist injection molding, water assisted injection molding, vacuum molding, compression molding, pultrusion or combinations of these processes, as known in the art. The decorative posts 110 can also be formed by a plastic forming process such as thermoforming, twin sheet thermoforming, extrusion forming, and combinations thereof.

Each post 110 can have at least one longitudinal vertical groove 120 formed in a side. The groove 120 can extend substantially along the length of the post 110. For example, the groove 120 can extend from a base securable to a surface, through an upper portion that receives the panels, to a top of the post. The groove 120 can be sized to receive an edge of a decorative wall panel 10. In one aspect, the groove 120 can be approximately 2 to 3 inches wide and approximately 1 to 3 inches deep. In another aspect, the groove 120 can be open to a top end of the post 110, and can extend toward a lower end of the post, but is not open to a bottom end of the post 110. Thus, in use, when the post 110 is placed in a hole, the groove 120 can extend into the hole. In this way, when concrete is placed in the hole to secure the post 110, the concrete can flow into and fill the groove 120, thereby anchoring the post 110 into the concrete and restricting axial displacement of the post 110 out of the concrete and hole. Additionally, apertures in the bottom of the post 110 formed by the fabrication process of the post 110 can allow concrete to flow into the post 110 itself, and provide additional anchoring forces and weight to the post.

The posts 110 can also have a plurality of longitudinal vertical grooves 120 to accommodate different positions in the fence system 100. In one aspect, the post 110 can be an end post 110*a* with only one longitudinal vertical groove 120. In another aspect, the post 110*b* can join two decorative fence panels 10 to form a substantially straight fence line and can have two longitudinal grooves 120 on opposite sides. In yet another aspect, the post 110 can be a corner post 110*c* joining two decorative fence panels 10 at an approximate right angle, and can have two longitudinal grooves 120 on adjacent sides. In still another aspect the post 110 can join three decorative fence panels 10, and can have three longitudinal grooves 120, on three adjacent sides. Additionally, the post can join four fence panels, and can have four longitudinal grooves 120, with one groove on each side of the post. It will be appreciated that although the grooves 120 are shown in the figures as being oriented generally at right angles to one another, the grooves can also be formed at oblique angles to one another to accommodate fences with corners of various angles, such as fences along non-uniform property lines.

Each post 110 can also include a reinforcing insert 130 extending axially along, or adjacent to the longitudinal axis of the post and disposed between the vertical grooves 120, as shown in FIG. 10. The reinforcing insert 130 can stiffen and strengthen the post 110.

Molding or forming a polymeric resin article about a rigid elongated member is described in U.S. patent application Ser. Nos. 11/009,186 and 11/003,709, which are incorporated herein by reference in their entirety for all purposes. As noted in these applications, shrinkage of a molded article about an elongate frame member, such as the reinforcing insert 130, during a plastic molding process can cause crushing and consequent deformation and damage (e.g. crushing) to core material in a shrinkage region adjacent to the end of the frame member. Thus, the reinforcing insert 130 can be an adhesion resistant reinforcing member as described in U.S. patent application Ser. No. 11/009,186, and/or a cavity or void can be formed around the end of the reinforcing insert 130 to provide a slip zone or crush zone around the end of the reinforcing member as described in U.S. patent application Ser. No. 11/003,709. Advantageously, adhesion resistance and crush zone cavities reduce the stresses on the end of the reinforcing member caused by post-molding shrinkage and thermal contraction of the polymer material. Reducing the stresses on the reinforcing inserts 130 can reduce deformation and damage to filler material and improve the shape and appearance of the molded posts 110.

The plurality of decorative fence panels 10 can be similar to the fence panel 10 described above and shown in FIGS. 1-4, and can be disposed between adjacent posts 110. Each decorative fence panel 10 can have a lateral peripheral edge 52 or lateral edge that can be at least partially disposed within the vertical grooves 120 of the adjacent posts 110. The decorative fence panel 10 can be retained in the vertical grooves by gravity alone, and does not require mechanical fasteners to secure the panel 10 to the post 110 (although mechanical fasteners can be utilized in certain circumstances). The vertical grooves 120 in the posts 110 can restrict displacement of the decorative panel to an axial plane of the adjacent posts, shown by dashed lines at 140 in FIG. 8. A gap 150 (FIG. 10) can be located between the bottom 122 of the vertical groove 120 and the decorative panel 10, or lateral sides of the walls, to accommodate thermal expansion of the decorative panel 10. Thus, the decorative fence panel 10 is capable of thermal expansion into and along the groove 120.

Advantageously, because the panels are light weight, repair and replacement of broken or damaged panels can be done quickly and easily. For example, if a panel 10 is broken, it can be replaced simply by lifting the broken panel out of the vertical grooves 120 and inserting a new panel 10 into the vertical grooves 120. In this way, a damaged fence can be repaired in a very short amount of time. Additionally, because of the polymeric resin, the outermost dimensions of the decorative fence panel are never bigger than the width of the vertical grooves. Thus, the panels can be cut to fit within a fencing section without affecting any physical properties such as strength, stiffness, rigidity, or heat transfer properties, of the panel.

Referring to FIG. 10, the elongated insert 50*a* can extend longitudinally along a top 54 of the decorative fence panel 10 between the opposite walls 20*a* and 20*b*. Additionally, the elongated insert 50*b* can extend longitudinally along a bottom 58 of the decorative panel 10 between the opposite walls 20*a* and 20*b* (see FIG. 4). In one aspect, the elongated inserts 50*a* and 50*b* can have opposite ends 56 that extend beyond the lateral peripheral edge, or perimeter 52 of the decorative panel 10, or lateral sides of the walls 20*a* and 20*b*. In another aspect, the elongated inserts 50 can be longer than the distance from a bottom 122 of a vertical groove 120 in one post 110 to a top of a facing vertical groove 120 in an adjacent post 110. In another aspect, the elongated inserts can be substantially as long as the distance between the bottoms of facing vertical grooves of adjacent posts. Thus, when a decorative panel 10 is slid between two adjacent posts 110, the elongated inserts 50*a* and 50*b* can engage the vertical grooves 120 in a zero clearance fit between the vertical grooves 120 of the two adjacent posts 110, and at the same time, leave room for the decorative panel 10 to expand or shrink from thermal expansion without interference from the posts 110.

Additional hardware can be used to facilitate installation of the fencing system 100. For example, a bracket can be secured in the groove near the bottom of the post 110 to position the elongated insert 50*b* in an axial position along the axis of the post 110. In this way, the decorative fence panel 10 can hang from the elongated inserts 50 between two posts 110. Thus, the decorative fence panel 10 is not constrained by the posts 110 or the elongated inserts 50*a* and 50*b* so that the decorative fence panel 10 can thermally expand and contract when hanging from the elongated inserts.

It will be appreciated that additional fence components, such as personnel gates, vehicle gates, and security gates can also be formed in accordance with the principles and technology of the present invention. For example, a personnel gate can be formed similarly to a decorative fence panel 10 and the gate can have a simulated decorative profile similar to adjacent fencing. In one aspect, a gate can conform to the height and decorative profile of the fence, thus maintaining the appearance of the fence, in order to conceal or blend the gate into the surrounding fence. In another aspect the gate can be defined by a molded border, or other offsetting features, as known in the art, so that the gate can be easily seen and accessed. Advantageously, the light weight of the polymeric resin can make the gate very light and easy to move, and the strength and rigidity of the plurality of nodes can make the gate very strong and durable. Thus, gates made from the present invention can be very large and yet easy to move. In this way, an entire fence can be fabricated and installed using the concepts of the present invention.

Turning now to FIGS. 11-14, a method for installing the fencing system 100 described above and illustrated in FIGS. 8-10, is shown. The method for installing the fencing system 100 includes securing a plurality of posts 110 having at least one vertical groove 120 to a support surface. For example, bottom ends of the posts can be buried in the ground, or in concrete. Alternatively, they may be bolted or otherwise fastened to decking or concrete pads. Elongated reinforcing inserts 50*a* and 50*b* can be slid into the top 54 and the bottom 58 of the decorative fence panel 10.

The decorative fence panel 10 can be slid into the vertical grooves 120 from openings near upper ends of the adjacent posts 110. The elongated reinforcing inserts 50*a* and 50*b* can engage the vertical grooves 120 to secure the decorative fence panel 10 between the adjacent posts 110. End caps 160 can be placed on the posts 110 after the decorative panel 10 is slid into the vertical grooves 120 of the adjacent posts 110. As described above, the posts can be spaced apart to accommodate the size of the panels, but the panels can also be cut to fit between adjacent posts.

Figure 15:
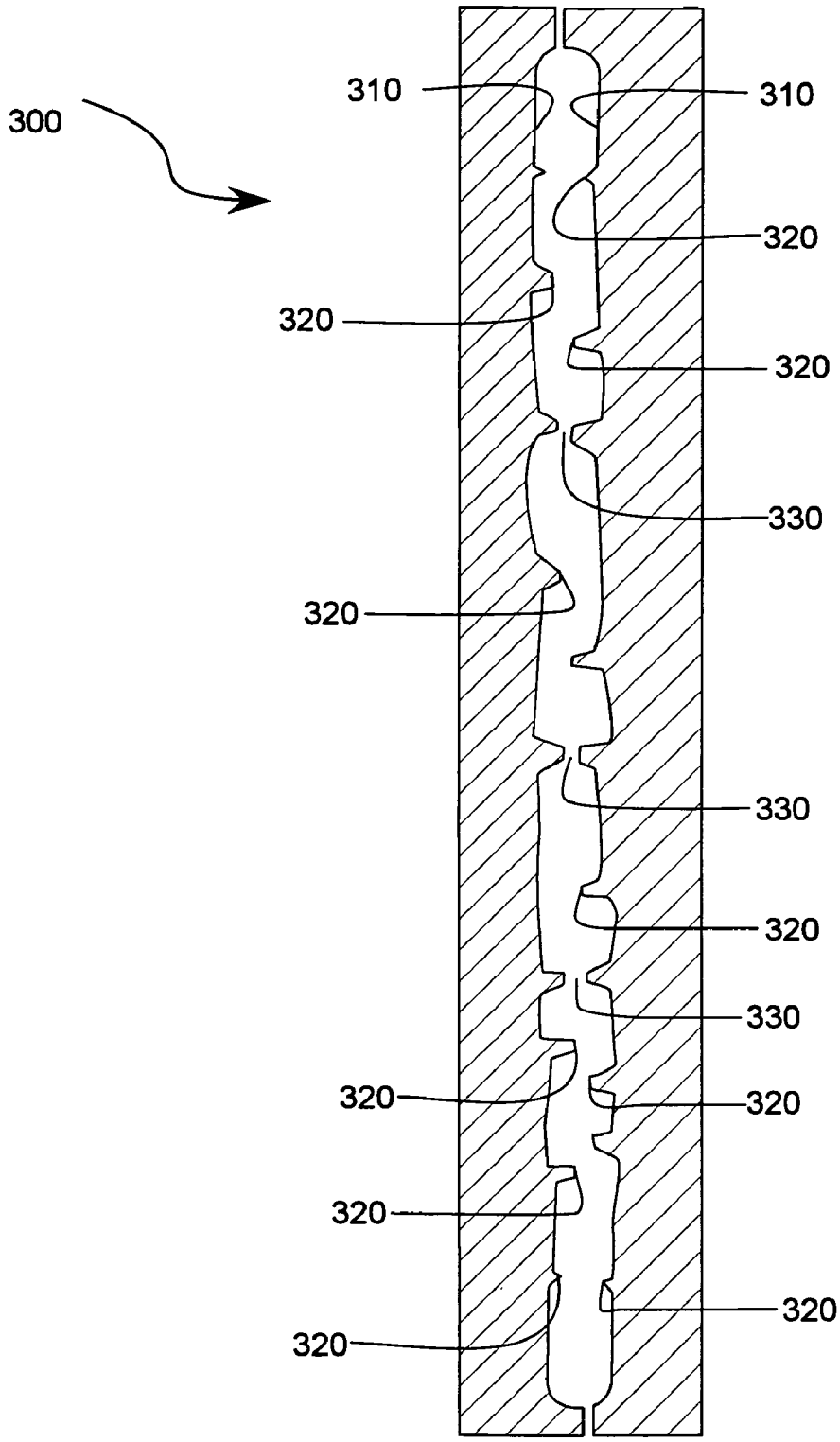
FIG. 15 is a cross section view of a mold for forming the decorative fence panel of FIG. 1.

Turning to FIG. 15, the present invention also provides for a method of making a decorative fence panel 10 including providing a mold 300 having opposing mold surfaces 310 with a grid of traversing protrusions 320 formed on each mold surface 310. The protrusions 320 can extend towards the opposing mold surface 310, and define an inverse decorative profile of a fence. The protrusions 320 also form a plurality of select gaps 330 between the grids of transverse protrusions 320. A moldable plastic material can be introduced into the mold.

The plastic material can be molded by a molding process to form a decorative fence panel. The molding process can form opposite plastic walls with opposite facing exterior surfaces having a grid of traversing channels indenting in towards the opposite wall to define a decorative profile of a fence. The plurality of gaps 330 between the grids of traversing protrusions 320 can form a plurality of separate and discrete connections between the grids of traversing channels of the opposite walls. The gaps 330 can have a separation distance approximately twice the thickness of the opposite plastic walls. The separate and discrete connections can form a plurality of continuous material nodes between the opposite walls The molding process can be rotational molding, blow molding, injection molding, gas assist injection molding, water assisted injection molding, vacuum molding, compression molding, pultrusion or combinations of these processes, as known in the art. In another aspect, the decorative fence panel can be formed by a plastic forming process such as thermoforming, twin sheet thermoforming, extrusion forming, and combinations thereof.

The present invention also provides for a method of making a decorative post 110 including providing a mold having opposing mold surfaces defining an inverse decorative profile of a post. A moldable plastic material can be introduced into the mold. The plastic material can be molded by a molding process to form a decorative post. The molding process can form continuous plastic walls. The molding process can be rotational molding, blow molding, injection molding, gas assist injection molding, water assisted injection molding, vacuum molding, compression molding, pultrusion or combinations of these processes, as known in the art. In another aspect, the decorative posts can be formed by a plastic forming process such as thermoforming, twin sheet thermoforming, extrusion forming, and combinations thereof. In addition, an insert can be disposed in the mold so that the plastic material surrounds the insert. Furthermore, a foaming agent can be introduced into the mold, such as by a drop box, to form a foam between the insert and the plastic walls.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A fence system, comprising:

a fence panel disposed between a plurality of posts, the fence panel including:

opposite plastic walls, having opposite facing exterior surfaces, each panel having a top and bottom end defining a height, and a first and second end defining a width;

each wall having a grid of intersecting elongated channels formed by inward deflections in the walls to define a plurality of protrusions between channels, the protrusions defining interior facing recesses; and a plurality of discrete physical connections, disposed across the decorative fence panel and formed between the opposite walls by select intersections of the channels of one wall intersecting with transversely oriented channels of the opposite wall, and inward deflections of one wall interesting inward deflections of the opposite wall, forming a plurality of continuous material nodes completely extending between the opposite walls; and the continuous material nodes being staggered, each node extending across only a partial height and width of the panel to define a continuous hollow space between the opposite plastic walls, interconnecting the plurality of recesses, and open across the entire panel extending between the top and bottom ends and between the first and second ends to allow for thermal transfer.

2. A fence system in accordance with claim 1, wherein the continuous material nodes transfer heat from one wall to the other to resist differential thermal expansion between the opposite walls and thus resist warping of the decorative fence panel.

3. A fence system in accordance with claim 1, wherein the decorative profile simulates a fence material selected from the group consisting of brick, stone, rock, wood slats, log poles, herring bone, lapped wood, cedar slats, wrought iron, lava rock, river rock, and combinations thereof.

4. A fence system in accordance with claim 1, wherein the opposite facing exterior surfaces of the opposite walls each have a different decorative profile of different fencing materials.

5. A fence system in accordance with claim 1, wherein the grid of intersecting channels are shaped and sized to simulate grout lines, mortar lines, or slat lines.

6. A fence system in accordance with claim 1, wherein the continuous material nodes have a thickness between the opposite facing exterior surfaces of approximately one to two times a thickness of the opposite plastic walls.

7. A fence system in accordance with claim 1, further comprising an elongated insert extending longitudinally along a top of the decorative fence panel between the opposite walls, and an elongated insert extending longitudinally along a bottom of the decorative fence panel between the opposite walls.

8. A fence system in accordance with claim 7, wherein the elongated inserts have opposite ends extending beyond a perimeter of the opposite walls.

9. A fence system in accordance with claim 7, wherein the elongated inserts are disposed between the opposite walls without mechanical fasteners.

10. A fence system in accordance with claim 1, wherein the plastic walls include a material selected from the group of olefins, styrenes, and mixtures thereof.

11. A fence system in accordance with claim 1, wherein the plastic walls include a thermoset or thermoplastic resin.

12. A fence system in accordance with claim 1, wherein the opposite walls have a constant material composition from the exterior surface to an interior surface.

13. A fence system in accordance with claim 1, wherein the grid of intersecting elongated channels have a different color than protrusions in the wall between the channels.

14. A fence system in accordance with claim 1, wherein the opposite plastic walls and connections are formed by a single rotationally molded panel.

15. A fence system in accordance with claim 1, wherein the grid of elongated channels of one wall is unaligned with the grid of elongated channels of an opposite wall.

16. A fence system in accordance with claim 1, wherein the channels forming the grids are irregular.

17. A fence system in accordance with claim 1, wherein the grid includes channels that intersect at right angles.

18. A fence system in accordance with claim 1, wherein the grid includes channels that intersect at oblique angles.

19. A fence system in accordance with claim 1, wherein the gird includes channels oriented horizontally and channels oriented vertically.

20. A fence system in accordance with claim 1, wherein the grid includes curvilinear channels.

21. A fence system in accordance with claim 1, wherein the protrusions have exterior surfaces textured with indentations and protrusions.

22. A fence system, comprising:

a plurality of decorative posts, securable to a support surface, and each post having at least one longitudinal vertical groove formed in a side;

a plurality of decorative fence panels, disposable between adjacent posts, each decorative fence panel having lateral peripheral edges at least partially disposable within vertical grooves of the adjacent posts, and each decorative fence panel comprising:

opposite plastic walls, having opposite facing exterior surfaces, each panel having a top and bottom end defining a height, and a first and second end defining a width;

each opposite wall having a grid of traversing channels formed by inward deflections in the walls to define a decorative profile of a fence; and a plurality of discrete physical connections, disposed across the decorative panel and formed between the opposite walls by select intersections of the grids of traversing channels, and inward deflections of one wall interesting inward deflections of the opposite wall, forming a plurality of continuous material nodes completely extending between the opposite walls; and a plurality of recesses in each wall defined between the channels;

the continuous material nodes being staggered, each node extending across only a partial height and width of the panel;

the recesses being interconnected by a continuous hollow space defined across the entire fence panel extending between the top and bottom ends and between the first and second ends without enclosing the recesses to resist differential thermal expansion between the opposite walls and thus resist warping of the decorative fence panel.

23. A fence system in accordance with claim 22, wherein the continuous material nodes form thermal and mechanical energy transfer paths between the opposite walls, to transfer thermal and mechanical energy between the opposite walls.

24. A fence system in accordance with claim 22, wherein each decorative fence panel is retained in the vertical grooves of adjacent posts only by gravity, and thus capable of thermal expansion into and along the groove.

25. A fence system in accordance with claim 22, wherein the at least one longitudinal vertical groove restricts displacement of the decorative panel to a plane of the panels.

26. A fence system in accordance with claim 22, further comprising a gap between a bottom of the at least one vertical groove and the lateral peripheral edge of the decorative fence panel to accommodate thermal expansion of the decorative panel.

27. A fence system in accordance with claim 22, wherein each of the plurality of decorative posts includes an axial reinforcing insert disposed between at least a pair of vertical grooves.

28. A fence system in accordance with claim 22, wherein each of the decorative fence panels further comprise an elongated insert extending longitudinally along a top of the decorative panel between the opposite walls and an elongated insert extending longitudinally along a bottom of the decorative fence panel between the opposite walls.

29. A fence system in accordance with claim 28, wherein the elongated inserts have opposite ends extending beyond a lateral end of the opposite walls.

30. A fence system in accordance with claim 29, wherein the opposite ends of the elongated inserts are disposable within the at least one vertical grooves of the adjacent decorative posts and contact a bottom of each of the vertical grooves of the adjacent decorative posts.

31. A fence system in accordance with claim 28, wherein the elongated inserts are disposed between the opposite walls without mechanical fasteners.

32. A fence system in accordance with claim 22, wherein the opposite plastic walls and connections are formed by a single rotationally molded panel that extends between adjacent posts.

33. A fence system in accordance with claim 22, wherein each wall has a plurality of protrusions surrounded by the channels configured to isolate thermal expansion.

34. A fence system in accordance with claim 33, wherein the protrusions have exterior surfaces textured with indentations and protrusions.

35. A method for installing a fence, comprising the steps of:

a) securing a plurality of posts, each having at least one vertical groove, to a support surface; and b) sliding a decorative fence panel into the vertical grooves of adjacent posts, the decorative panel including opposite plastic walls with opposite facing exterior surfaces, each panel having a top and bottom end defining a height, and a first and second end defining a width having a grid of traversing channels formed by inward deflections in the opposite walls to define a decorative profile of a fence, and a plurality of discrete physical connections between the grids of traversing channels of the opposite walls inward deflections of one wall interesting inward deflections of the opposite wall forming a plurality of continuous material nodes completely extending between the opposite walls and a plurality of inwardly facing recesses formed in each wall between the channels the continuous material nodes being staggered, each node extending across only a partial height and width of the panel to define a continuous hollow space across the entire fence panel extending between the top and bottom ends and between the first and second ends without enclosing the recesses to allow for thermal transfer.

36. The method of claim 35, further comprising the step of:

sliding the decorative panel into the vertical grooves from openings near upper ends of the posts, such that elongated reinforcing members engage bottoms of the vertical grooves to secure the decorative panel between the adjacent posts.

37. A fence system, comprising:

a fence panel disposed between a plurality of posts, the fence panel including:

opposite plastic walls, having opposite facing exterior surfaces, each panel having a top and bottom end defining a height, and a first and second end defining a width;

each exterior surface having a different grid of traversing channels formed by inward deflections in the walls to define a different decorative profile of a fence in each exterior surface simulating a different fence material; and a plurality of discrete physical connections, disposed across the decorative panel and formed between the opposite walls by select intersections of the grids of traversing channels of the opposite walls, and inward deflections of one wall interesting inward deflections of the opposite wall, forming a plurality of continuous material nodes of thermal and mechanical energy transfer paths completely extending between the opposite walls to transfer thermal and mechanical energy between the opposite walls; and a plurality of recesses defined between the channels, the continuous material nodes being staggered, each node extending across only a partial height and width of the panel to define a hollow space across the entire panel extending between the top and bottom ends and between the first and second ends without enclosing the recesses to allow for thermal transfer.

38. A fence system in accordance with claim 37, wherein the decorative profile in each exterior surface simulates a fence material selected from the group consisting of brick, stone, rock, wood slats, log poles, herring bone, lapped wood, cedar slats, wrought iron, simulated wood, simulated rock, simulated stone, simulated brick lava rock, and combinations thereof.

39. A fence system, comprising:

a fence panel disposed between posts, the fence panel including:

opposite plastic walls having opposite facing exterior surfaces, each panel having a top and bottom end defining a height, and a first and second end defining a width;

each wall having a grid of intersecting channels formed by inward deflections in the walls to define a profile of a fence;

a plurality of discrete physical connections between the opposite walls disposed across the decorative fence panel and formed between the opposite walls by select intersections of the grids of channels in the walls, inward deflections of one wall intersecting inward deflections of the opposite wall, forming a plurality of continuous material nodes completely extending between the opposite walls; and a plurality of recesses formed in each wall between the channels, the continuous material nodes being staggered, each node extending across only a partial height and width of the panel to define a continuous hollow space across the entire panel extending between the top and bottom ends and between the first and second ends without enclosing the plurality of recesses.

40. A fence system in accordance with claim 39, wherein each wall has a plurality of protrusions surrounded by the channels configured to isolate thermal expansion.

41. A fence system in accordance with claim 40, wherein the protrusions have exterior surfaces textured with indentations and protrusions.

42. A fence system in accordance with claim 39, wherein the opposite plastic walls and the connections therebetween are formed as a single rotationally molded panel.

* * * * *